US008083082B2

(12) United States Patent
Sasaki

(10) Patent No.: US 8,083,082 B2
(45) Date of Patent: Dec. 27, 2011

(54) LARGE BOTTLE-SHAPED CONTAINER HAVING SUBSTANTIALLY RECTANGULAR CROSS SECTION

(75) Inventor: Masaaki Sasaki, Koto-Ku (JP)

(73) Assignee: Yoshino Kogyosho Co., Ltd., Tokyo (JP)

( * ) Notice: Subject to any disclaimer, the term of this patent is extended or adjusted under 35 U.S.C. 154(b) by 168 days.

(21) Appl. No.: 12/453,668

(22) Filed: May 18, 2009

(65) Prior Publication Data

US 2009/0266786 A1 Oct. 29, 2009

Related U.S. Application Data

(63) Continuation of application No. 10/593,229, filed as application No. PCT/IB2005/001000 on Apr. 14, 2005, now abandoned.

(60) Provisional application No. 60/562,559, filed on Apr. 16, 2004.

(51) Int. Cl.
*B65D 1/02* (2006.01)
*B65D 23/10* (2006.01)

(52) U.S. Cl. ..... 215/384; 215/371; 215/398

(58) Field of Classification Search ..... 215/371–384, 215/398; 220/669–671, 675
See application file for complete search history.

(56) References Cited

U.S. PATENT DOCUMENTS

| | | | |
|---|---|---|---|
| 3,537,498 | A | 11/1970 | Amand |
| 5,381,910 | A | 1/1995 | Sugiura et al. |
| 6,161,713 | A | 12/2000 | Krich |
| 6,575,321 | B2 | 6/2003 | Bourque et al. |
| 2003/0136754 | A1 | 7/2003 | Bourque et al. |
| 2003/0205550 | A1 | 11/2003 | Prevot et al. |
| 2004/0164046 | A1 | 8/2004 | Kelley |
| 2006/0054587 | A1 | 3/2006 | Oguchi et al. |

FOREIGN PATENT DOCUMENTS

| | | |
|---|---|---|
| JP | A-08-230856 | 9/1996 |
| JP | B 3059975 | 4/2000 |
| WO | WO 02/32768 A1 | 4/2002 |
| WO | WO 02/057146 A2 | 7/2002 |
| WO | WO 03/057571 A1 | 7/2003 |

*Primary Examiner* — Sue Weaver
(74) *Attorney, Agent, or Firm* — Oliff & Berridge, PLC

(57) ABSTRACT

A large container made of synthetic resin, and comprising a neck and a body; the body having a substantially rectangular cross section, and including an upper body and a lower body; the upper body containing a center of gravity of the container when filled with liquid; the upper body having a waist section containing the center of gravity; the waist section having a grip, the grip being not adapted to absorb a negative pressure in the container; and at least one surface of the lower body including a vacuum panel.

20 Claims, 4 Drawing Sheets

LARGE BOTTLE-SHAPED CONTAINER HAVING SUBSTANTIALLY RECTANGULAR CROSS SECTION

This is a Continuation of application Ser. No. 10/593,229 filed Oct. 16, 2006, which in turn is a National Phase of PCT/IB2005/001000, filed Apr. 14, 2005, which claims the benefit of U.S. Provisional Application No. 60/562,559 filed Apr. 16, 2004. The disclosure of the prior applications is hereby incorporated by reference herein in their entirety.

BACKGROUND OF THE INVENTION

1. Field of the Invention

This invention relates to a large bottle-shaped container having a substantially rectangular cross section. More particularly, the present invention relates to a bottle-shaped container that does not need to absorb a reduced internal pressure in the container by a grip thereof, and that has an improved rigidity for the entire container.

2. Related Background Art

So-called 64-ounce containers (having a weight capacity of about 1.8 kg and a volume capacity of about 1.8 liters) and other large containers (bottles) in the U.S. market show a shift from those having a substantially circular cross section to those having a substantially rectangular cross section, from a viewpoint of easy handling on a route of delivery and in a shop.

U.S. Pat. No. 6,575,321 discloses a bottle-shaped container having a neck, a body portion including a top portion and a bottom portion, and a bottom. The body portion of the disclosed container is provided with a vacuum panel for accomodating an internal force at the bottom portion, and with grip portion at the top portion.

Meanwhile, it is sometimes impossible for a large bottles to absorb a reduced internal pressure in the bottle only by means of vacuum panels of the bottom portion. For this reason, the bottle of the above cited U.S. Patent is so devised that the grip acts as an auxiliary vacuum panel in order to reduce the internal pressure that cannot be completely absorbed by the vacuum panels of the bottom portion.

However, since the grip acts as an auxiliary vacuum panel, the grip by turn is forced to show a reduced rigidity. Additionally, the grip is deformed not only by the internal pressure of the bottle but also by an external pressure of the bottle (e.g., a force applied by the user when gripping the bottle). Then, there arises a risk that the grip is permanently deformed and that an appearance of the bottle is damaged as a result of permanent deformation. Still additionally, since the vacuum panels inevitably show a large total surface area (particularly when a further vacuum panel is formed in the top portion in addition to the vacuum panel formed in the grip), such a large total surface area of the vacuum panels by turn restricts a design freedom of the bottle.

SUMMARY OF THE INVENTION

In view of the above described circumstances, it is therefore an object of the present invention to provide a large bottle-shaped container having a substantially rectangular cross section, which container shows an improved property for absorbing a reduced internal pressure by the lower body, and does not need to absorb the reduced internal pressure by the grip thereof, while showing an improved rigidity as a whole.

In the first aspect of the present invention, the above object is achieved by providing a large container made of synthetic resin, and comprising a neck and a body; said body having a substantially rectangular cross section, and including an upper body and a lower body; said upper body containing a center of gravity of the container when filled with liquid; said upper body having a waist section containing the center of gravity; said waist section having a grip, said grip being not adapted to absorb a negative pressure in the container; at least one surface of said lower body including a vacuum panel.

Preferably, said waist section has a height equal to about 20 to 40% of a height of said upper body. Preferably, said waist section has a depth of 4 to 15 mm relating to the largest diameter of said upper body.

Preferably, said grip has a height not greater than about 33% of a height of said upper body. Preferably said grip has a width equal to about 35 to 80%, most preferably about 60 to 80%, of a width of a longer side of said upper body. Preferably, said grip has a depth of about 5 mm or less from a wall of said waist section.

Preferably, said vacuum panel has an area equal to 30.6 to 48.6% of a surface area of said lower body. Preferably, said lower body has a substantially flat label section, and said vacuum panel has an area equal to about 39.3 to 62.4% of an area of said label section.

Preferably, said pressure vacuum panel has at least one transversal rib. Preferably, said transversal rib has a width not smaller than 85.0% of a width of said vacuum panel.

In the second aspect of the present invention, there is provided a large container made of synthetic resin, and comprising a neck and a body; said body having a substantially rectangular cross section, and including an upper body and a lower body; said upper body containing a center of gravity of the container when filled with liquid; said upper body having a rib containing the center of gravity; said rib being not adapted to absorb a negative pressure in the container; at least one surface of said lower body including a vacuum panel.

Said rib operates as a grip.

Preferably, said rib has a height equal to about 2 to 10% of a height of said upper body. Preferably, said rib has a depth of 2 to 5 mm relating to the largest diameter of said upper body.

Preferably, said vacuum panel has an area equal to 23.3 to 42.0% of a surface area of said lower body. Preferably, said lower body has a substantially flat label section, and said vacuum panel has an area equal to about 31.3 to 56.2% of an area of said label section.

Preferably, said vacuum panel has at least one transversal rib. Preferably, said transversal rib has a width not smaller than 85.0% of a width of said vacuum panel.

According to the invention, it is not necessary to provide a grip capable of absorbing the reduced internal pressure, at a portion (waist section or circumferential rib of the present invention) containing a center of gravity of the container when filled with liquid, so as to easily grip the container with high rigidity.

Additionally, according to the invention, the container has a vacuum panel showing a large area, so that all the negative pressure generated in the container is absorbed by the lower body, and the grip and the upper body are not affected by negative pressure to improve the rigidity of the bottle.

Finally, the container according to the invention shows an improved resilience particularly at the panel by forming a transversal rib in the vacuum panel, so that it is possible to prevent permanent deformation from taking place.

DESCRIPTION OF THE PREFERRED EMBODIMENTS

Figure 1:
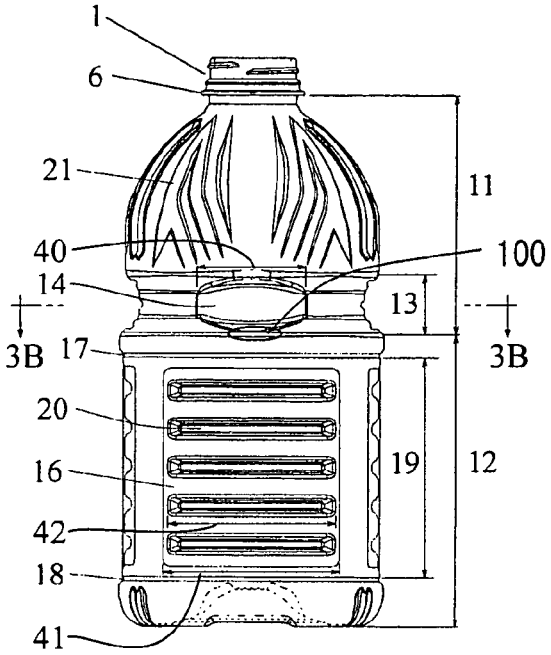
FIG. 1 is a schematic front view of an embodiment of the first aspect of the invention.
Figure 2:
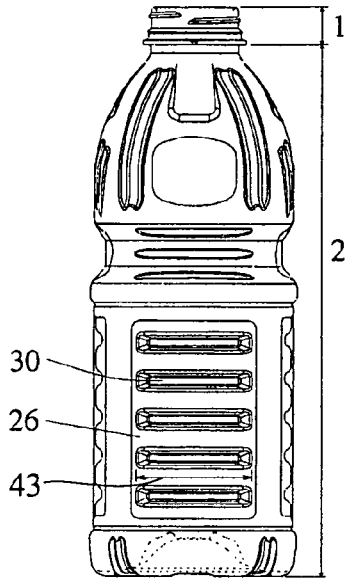
FIG. 2 is a schematic lateral view of the embodiment of the first aspect of the invention.

Now, firstly a container in the first aspect of the present invention will be described by referring to FIGS. 1-6.

FIGS. 1-6 illustrate a bottle-shaped container according to the invention which is a large 64-ounce bottle having a weight capacity of about 1.8 kg and a volume capacity of about 1.8 liters). While the present invention is not limited to a container having a volume capacity of 1.8 liters, it is particularly effective for a container having a volume capacity not smaller than 1 liter. It is equally effective for a container having a volume capacity of 2 liters or 3 liters. The bottle-shaped container comprises a neck 1 and a body 2. The container is manufactured by using a known synthetic resin material, which may typically be polyethylene terephthalate.

The body 2 comprises an upper body 11 and a lower body 12. The body 2 shows a substantially rectangular cross section, and hence has longer sides and shorter sides.

The upper body 11 includes a narrowed waist section 13 located at a lower end thereof. The waist section 13 refers to a part showing a reduced diameter. The waist section 13 includes an area 100 including the center of gravity of the container when the container is filled with liquid. The waist section 13 is provided at the longer sides thereof with respective grips 14.

In the embodiment illustrated in FIGS. 1-6, the "upper body" 11 means a part of the container extending from a lower end of a neck ring 6 of the neck 1 to a lower end of the waist section 13, whereas the lower body 12 means a part of the container extending from the lower end of the waist section 13 to a grounding surface of the container.

The waist section 13 has a height which is equal to about 20 to 40% of a height of the upper body 11. If the height of the waist section 13 is smaller than 20% of that of the upper body 11, it is not possible for each of the grips 14 to have a height that allows a finger tip to be received there. If, on the other hand, the height of the waist section 13 is greater than 40%, each of the grips 14 has a too large area, and hence would easily be deformed by the reduced internal pressure of the container or by an external pressure (particularly grasp by the user).

The waist section 13 has a depth of 4 to 15 mm relating to the largest diameter of the upper body 11. If the depth is smaller than 4 mm, the oppositely disposed grips 14 are separated from each other too far (in a radial direction), and it is difficult for the user to grasp and hold the container at the grips 14. If, on the other hand, the depth is greater than 15 mm, the container shows a too small width at the waist section 13 to consequently reduce the strength of the entire container.

As described above, the waist section 13 is provided at each of the longer sides thereof with respective grips 14. Each of the grips 14 is rigid, so that the user may easily grip the container. In other words, each of the grips 14 does not act as vacuum panel, or does not absorb the reduced internal pressure. To make the grip 14 rigid, an area of each of the grip sections 14 is made so small as to only snugly receive a finger tip. Alternatively or additionally, the grip 14 may be made to have a large wall thickness.

In order to reduce the area of the grip 14, the grip 14 is made to show a height (the axial length of the container) not greater than about 33% of the height of the upper body 11. If the height of the grip 14 exceeds 33% of the height of the upper body 11, the grip 14 comes to show a too large area, so that it would be easily deformed by the reduced internal pressure of the container or by the external pressure. Note that the grip section 14 is made to show the height greater than the width of a finger tip, so that it can receive the finger tip.

A width 40 (a length in a circumferential direction of the container) of each of the grips 14 is made equal to about 35 to 80% of the width of the upper body 11, most preferably 60 to 80%. If the width 40 of the grip 14 is smaller than 35% of the width of the upper body 11, it is not possible for the grip 14 to receive a finger tip so that the user may not be able to grasp and hold the container at the grip 14. If, on the other hand, the width of each of the grips 14 is greater than 80%, the grip 14 has a too large area and would be easily deformed by the reduced internal pressure of the container and the external pressure. Since the grip 14 is made to have a small area as described above, the grip is not deformed even if the internal pressure is reduced.

Each of the grips 14 is made to have a depth of about 5 mm or less from the wall surface of the waist section 13. In other words, each of the grips 14 has a bottom wall which is recessed from the wall surface of the waist section 13 by about 5 mm or less. If the depth exceeds 5 mm, a finger tip cannot reach to the bottom wall of the grip 14, so that the user may not be able to stably grasp and hold the container. Preferably, the grip 14 is made to have the depth of about 2 mm or more. If the depth is less than 2 mm, the finger tip hardly engages with the grip 14, so that the finger tip may easily slip away.

As described above, the upper body 11 does not absorb any negative pressure that may be generated in the inside of the container. For this reason, a vacuum panel having an area adapted to absorb the entire negative pressure is formed on at least one of the surfaces of the lower body 12. In the embodiment of FIGS. 1-4, two vacuum panels 16, 16 are formed respectively on the longer sides, and two vacuum panels 26, 26 are formed respectively on the shorter sides of the lower body 12.

In the container illustrated in FIGS. 1-6, a first recessed narrow rib 17 is formed near an upper end of the lower body 12, and a second narrow recessed rib 18 is formed near a lower end of the lower body 12, to strengthen or reinforce the container. At a portion from a lower end of the first recessed rib 17 to an upper end of the second recessed rib 18, the surfaces of the container are substantially flat, so that one or more than one labels may be applied to such portion, although no label is shown in FIGS. 1-6. Such substantially flat portion between the lower end of the first recessed rib 17 and the upper end of the second recessed rib 18 is referred to as label section 19.

It is well known that negative pressure is generated in a container when liquid content of the container are cooled after filling the container with the heated contents and closing the cap. Since the container is deformed by such negative pressure, it is necessary to absorb the negative pressure in the container. According to the present invention, the negative pressure is absorbed exclusively by the lower body 12 of the container. Thus, the lower body 12 is provided with at least a vacuum panel 16 arranged on at least one of the surfaces thereof. In this case, it is necessary to consider how to secure the strength of the container. Dimensions (width, height and area) of the vacuum panel 16 are determined according to a necessary amount (capacity) of the negative pressure to be absorbed.

In the case of the container (having a waist section 13) as illustrated in FIGS. 1-6, a total area of the vacuum panels 16, 16 and 26, 26 is made equal to 30.6% to 48.6% of a surface area of the lower body 12 (except a grounding surface). If the total area is less than 30.6%, the vacuum panels cannot sufficiently absorb the negative pressure, and hence the container would be deformed. If, on the other hand, the total area exceeds 48.6%, the strength of the entire container would be reduced.

In order to secure the strength of the container in addition to the above described absorption of the negative pressure by only the lower body 12, the total area of the vacuum panels 16, 16 and 26, 26 is made equal to 39.3% to 62.4% of a surface area of the label section 19 of the container (having a waist section 13) as illustrated in FIGS. 1-6. The label section 19 is substantially flat as described above, and hence it is deformed inwardly when the negative pressure is generated in the inside of the container. In other words, the area of the vacuum panels 16 relative to the surface area of the label section 19 is also considered. If the total area is less than 39.3%, they cannot sufficiently absorb the negative pressure, so that the container would be deformed. If, on the other hand, the total area exceeds 62.4%, the strength of the entire container would be reduced.

Each of the vacuum panels 16, 16 is provided with one or more transversal ribs 20 in order to restore the vacuum panel 16 if it is deformed by the negative pressure, and at the same time in order to strengthen the vacuum panel 16. Similarly, each of the vacuum panels 26, 26 is provided with one or more transversal ribs 20, because of the same reason. In the case of the embodiment illustrated in FIGS. 1-6, each of the vacuum panels 16, 16 is provided with five transversal ribs 20, and each of the vacuum panels 26, 26 is also provided with five transversal ribs 30, although the present invention is by no means limited thereto.

Each of the transversal ribs 20 preferably has a horizontal length not smaller than 85.0% the width 41 of the vacuum panel 16. Similarly, each of the transversal ribs 30 preferably has a horizontal length, i.e., width 43 not smaller than 85.0% of the width of the vacuum panels 26. When the transversal ribs 20 and 30 are made to have horizontal lengths respectively not smaller than 85.0% of the width of the vacuum panels 16 and 26, each of the vacuum panels 16 and 26 shows a remarkably improved restoring force, and hence it is possible to effectively strengthen the panels.

A total of axial lengths of the transversal ribs 20 (or 30) is preferably equal to 33 to 52% of the axial length of the corresponding vacuum panel 16 (or 26). If the total is less than 33%, the vacuum panel is not strengthened effectively. If, on the other hand, the total exceeds 52%, the amount of the absorption would be too small.

An area of each of the transversal ribs 20 (or 30) is preferably equal to 30 to 49% of the area of the corresponding vacuum panel 16 (or 26). If the area is less than 30%, the vacuum panel is not strengthened effectively. If, on the other hand, the area exceeds 49%, the amount of the absorption would be too small.

In the case of the illustrated embodiment, the upper body 11 is provided with a plurality of projections 21 that extend in the axial direction of the container. While the projections 21 are formed to provide the container with an aesthetic effect, they also serve as anti-slip effect if the user holds the upper body 11 of the container.

Figure 3A:
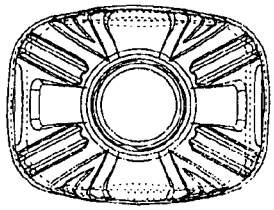
FIG. 3A is a schematic plan view of the embodiment of the first aspect of the invention.
Figure 3B:
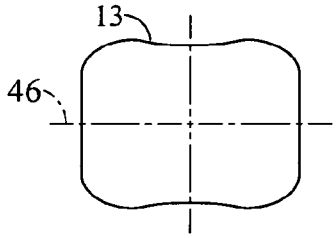
FIG. 3B is a schematic cross section view of the embodiment of the first aspect of the invention, showing two perpendicular axes and an arcuate cross section.
Figure 4:
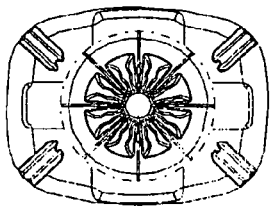
FIG. 4 is a schematic bottom view of the embodiment of the first aspect of the invention.
Figure 5:
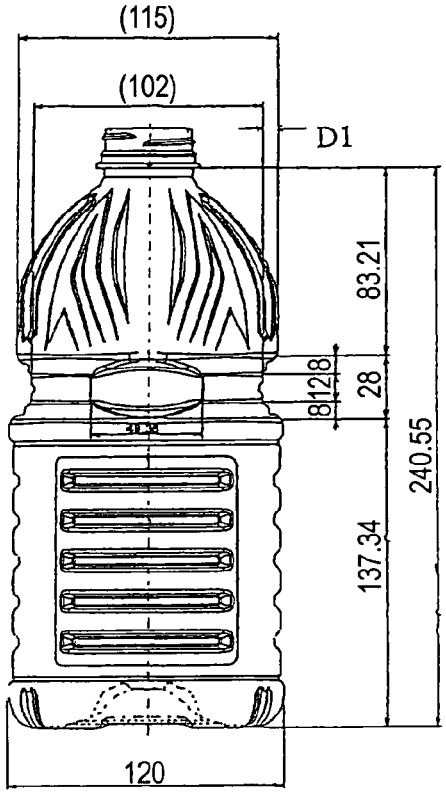
FIG. 5 is a schematic front view of the embodiment of the first aspect of the invention same as that illustrated in FIG. 1 except that the vacuum panels are not formed on the shorter sides, and that the dimensions of some parts are shown.
Figure 6:
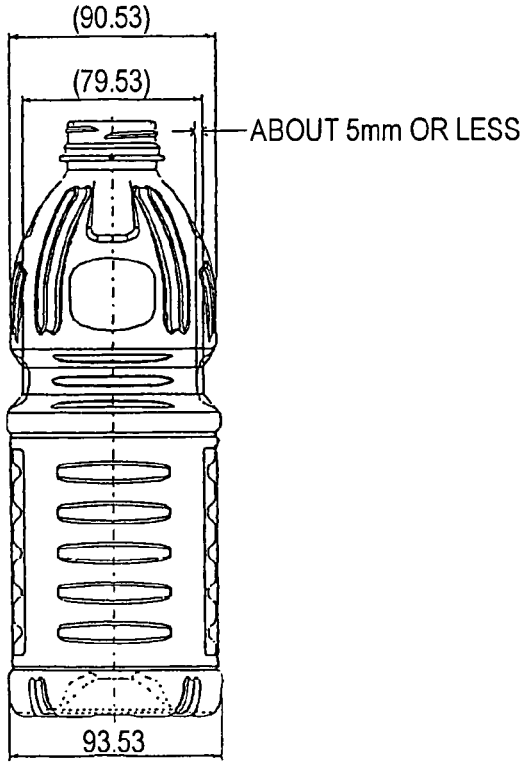
FIG. 6 is a schematic lateral view of the embodiment of the first aspect of the invention same as that illustrated in FIG. 2 except that the vacuum panels are not formed on the shorter sides, and that the dimensions of some parts are shown.
Figure 7:
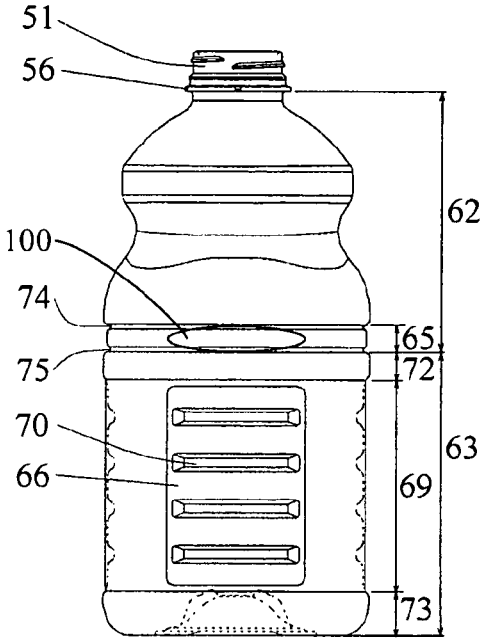
FIG. 7 is a schematic front view of an embodiment of the second aspect of the invention.
Figure 8:
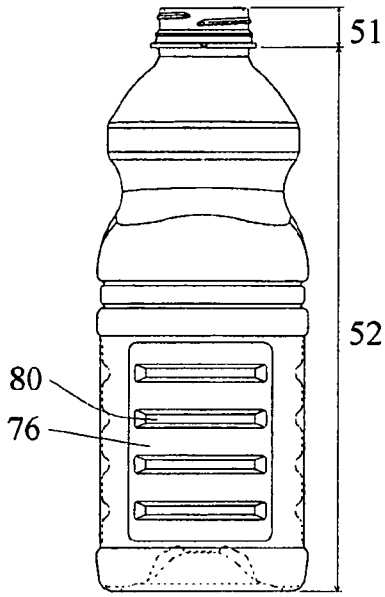
FIG. 8 is a schematic lateral view of the embodiment of the second aspect of the invention.
Figure 9:
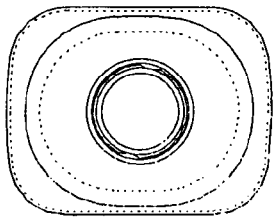
FIG. 9 is a schematic plan view of the embodiment of the second aspect of the invention.
Figure 10:
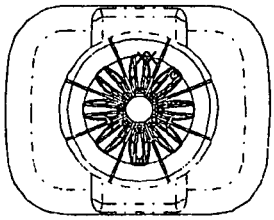
FIG. 10 is a schematic bottom view of the embodiment of the second aspect of the invention.

FIG. 3B shows an arcuate cross section of waist 13 and two perpendicular axes 46. FIGS. 5 and 6 show an example which is substantially same as the example illustrated in FIGS. 1-4, except that the vacuum panel 26 is not formed on the shorter sides of the lower body 12. While FIGS. 5 and 6 show dimensions of some parts of the container, the present invention is by no means limited thereto. In the example of FIGS. 5 and 6, the upper body 11 includes the waist section 13, the upper body 11 shows a height of 111.21 mm, the waist section 13 shows a height of 28 mm, and the lower body 12 shows a height of 137.34 mm. The difference in width between the outer circumference of the projections 21 and the inner circumference of the waist section 13 is labeled as D1.

In line with the invention as illustrated in FIGS. 1-6, the synthetic resin container was prepared or formed. Note that the formed container has dimensions (particularly, the vacuum panel 26) that are not same as those illustrated in FIGS. 1-4 and 5-6.

Circumferential length of the lower body 12: 353.8 mm

Height of the lower body 12: 137.34 mm

Height of the label section 19: 107 mm

Surface area of the lower body 12: (353.8×137.34=) 48590.9 $mm^2$

The container having the above listed dimensions showed a capacity of 64 ounces (about 1.8 liters). The internal pressure of the container is reduced when the temperature of the contents is reduced from about 70 to 100° C. to the room temperature in a state where the cap is closed. The capacity necessary to absorb the pressure reduction is at least 60 ml, preferably not less than 80 ml.

In order to absorb such capacity, vacuum panels 16, 16 and 26, 26 were formed respectively on the longer sides and the shorter sides of the lower body 12. Vacuum panels 16 have width 41.

Each of the vacuum panels 16 on longer sides: 80 mm (width)×93 mm (height)

Each of the vacuum panels 26 on shorter sides: 53.2 mm (width)×82 mm (height)

Area of the panel 16 on each longer side: 80 mm (width)×93 mm (height)=7440 $mm^2$ Total area of the panels 16, 16 on longer sides: 7440 $mm^2$×2=14880 $mm^2$ Area of the panel 26 on each shorter sides: 53.2 mm (width)×82 mm (height)=4362.4 $mm^2$ Total area of the panels 26, 26 on shorter sides: 4362.4 $mm^2$×2=8724.8 $mm^2$ Total area of the panels 16, 16, 26, 26: 14880 $mm^2$+8724.8 $mm^2$=23604.8 $mm^2$ Thus, the container of this example can absorb 60 ml (preferably 80 ml) by means of the vacuum panels having the total area of 23604.8 $mm^2$.

After opening the cap, the reduced pressure or the negative pressure in the inside of the container is dissolved. In this case, the vacuum panels restore the original profiles. In order to improve the restoration, each of the panels 16, 16 is provided with five transversal ribs 20, and each of the panels 26, 26 is provided with five transversal ribs 30.

Transversal ribs 20 on each panel 16 of longer sides: 75 mm (width)×8 mm (height)×5

Ratio of the horizontal length (width) 42 of each transversal rib 20 to the horizontal length of corresponding panel 16: 75/80=93.7%

Ratio of a total axial length (height) of five transversal ribs 20 to the axial length of corresponding panel 16: (8×5)/93=43.0%

Ratio of a total area of five transversal ribs 20 to the area of corresponding panel 16: (76×8×5)/7440=40.3%

Transversal ribs 30 on each panel 26 of shorter sides: 50.6 mm (width)×8 mm (height)×5

Ratio of the horizontal length (width) of each transversal rib 30 to the horizontal length of corresponding panel 26: 50.6/53.2=95.17%

Ratio of a total axial length (height) of five transversal ribs 30 to the axial length of corresponding panel 26: (8×5)/82=48.8%

Ratio of a total area of five transversal ribs 30 to the area of corresponding panel 26: (50.6×8×5)/(53.2×82)=46.4%

The container was filled with liquid heated to about 90° C., and capped. Subsequently, the container was observed until the contained liquid is cooled to the room temperature. Although the vacuum panels 16, 26 were deformed inwardly, the appearance of the container was not significantly affected. It was confirmed that the vacuum panels 16, 26 restored their original profiles when the cap was removed.

Now, a container in the second aspect of the present invention will be described by referring to FIGS. 7-12.

The container illustrated in FIGS. 7-12 is a bottle-shaped container made of a synthetic resin. It comprises a neck 51 and a body 52, and has a volume capacity same as the container illustrated in FIGS. 1-6.

A body 61, 62 comprises an upper body 61 and a lower body 62. The body 52 shows a substantially rectangular cross section, and hence has longer sides and shorter sides.

The container of this embodiment does not have a narrowed waist section at and near the area 100 including the center of gravity of the container when filled with liquid. Instead, it is provided with a rib 65 at and near the area 100 including the center of gravity. The rib 65 strengthens or reinforces the walls of the container at and near the center of gravity, so that the user can easily grasp and hold the container at the rib 65. The rib 65 does not absorb the reduced internal pressure.

In the embodiment illustrated in FIGS. 7-12, the expression of the "upper body" 61 refers to a part of the container extending from a lower end of a neck ring 56 of the neck 51 to a lower end of the rib 65, and the expression of the "lower body" 62 refers to a part of the container extending from the lower end of the rib 65 to a grounding surface of the container.

The rib 65 is recessed by 2 to 5 mm relating to the largest diameter of the upper body 61, so as to snugly receive a finger tip. Thus, the user can stably grasp and hold the container. If the rib 65 is recessed by less than 2 mm, a finger tip hardly engages with the rib 65, and hence the finger tip may easily slip away. If, on the other hand, the rib 65 is recessed by more than 5 mm, the finger tip can not reach to the bottom wall of the rib 65, so that the user may not be able to stably grasp and hold the container.

The height (the length in the axial direction of the container) of the rib 65 is equal to about 2 to 10% of the height of the upper body 61. If the height is less than 2%, the height of the strong wall (the length in the axial direction of the container) is too small, so that the user may not be able to stably grasp and hold the container. If, on the other hand, the height exceeds 10%, the rib 65 shows a too large area, so that the it may be deformed when the internal pressure of the container is reduced.

The rib 65 operates as grip of the container. Therefore, it is not necessary to provide the container illustrated in FIGS. 7-12 with grips unlike the container illustrated in FIGS. 1-6, although grip may be formed on the rib 65.

As described earlier, the upper body 61 of the container does not absorb any negative pressure that may be generated in the container. For this reason, a vacuum panel having an area adapted to absorb the entire negative pressure is formed on at least one of the surfaces of the lower body 62. In the embodiment of FIGS. 7-12, two vacuum panels 66, 66 are formed respectively on the longer sides, and two vacuum panels 76, 76 are formed respectively on the shorter sides of the lower body 62.

In the container illustrated in FIGS. 7-12, the lower body 62 has a strip section 72 arranged at an upper end thereof and a bottom 73 arranged at a lower end thereof. The surfaces of the container are substantially flat between the strip section 72 and the bottom 73, so that a label may be applied to such flat surfaces, although no label is shown in FIGS. 7-12. Such substantially flat portion between the strip section 72 and the bottom 73 is referred to as label section 69.

In the case of the container illustrated in FIGS. 7-12, the negative pressure is absorbed exclusively by the lower body 62. Thus, the lower body 62 is provided with a vacuum panel 66, 76 arranged on at least one of the surfaces thereof. Dimensions (width, height and area) of the vacuum panel 66, 76 are determined according to a necessary amount (capacity) of the negative pressure to be absorbed.

In the case of the container as illustrated in FIGS. 7-12, a total area of the vacuum panels 66, 76 is made equal to 23.3% to 42.0% of the surface area of the lower body 52 (in the case of the container illustrated in FIGS. 1-6, 30.6% to 48.6%, as described above). The total area of the vacuum panels 66, 76 is made equal to 31.3% to 56.2% of a surface area of the label section 69 (in the case of the container illustrated in FIGS. 1-6, 39.3% to 62.4%, as described above). In other words, the above figures of the second aspect are smaller than the corresponding figures of the embodiment illustrated in FIGS. 1-6. This is because the container illustrated in FIGS. 1-6 has the waist section 13 (of a reduced diameter), which does not absorb any negative pressure at all. To the contrary, the container illustrated in FIGS. 7-12 does not have such waist section, and has the rib 65 having the height (axial length) smaller that of the waist section, so that the area of the label portion of the container of FIGS. 7-12 is larger than that of the container of FIGS. 1-6. Therefore, both the ratio of the total area of the vacuum panels 66, 76 relative to the surface area of the lower body 62 and the ratio thereof relative to the surface area of the label section 69 may be smaller than their respective counterparts of the embodiment of FIGS. 1-6.

When the total area of the vacuum panels 66, 76 is smaller than either of the above ranges, it may not possible to sufficiently absorb the negative pressure, and hence the container would be deformed. If the total area of the vacuum panels 66, 76 exceeds either of the above ranges, the entire container may show a reduced strength.

As in the case of the container illustrated in FIGS. 1-6, each of the vacuum panels 66, 66 is provided with one or more transversal ribs 70, and each of the vacuum panels 76, 76 is provided with one or more transversal ribs 80. In the illustrated embodiment, each of the vacuum panels 66, 66 is provided with four transversal ribs 70, and each of the vacuum panels 76, 76 is also provided with four transversal ribs 80. A horizontal length, an axial length and an area of each of the transversal ribs 70 and those of the transversal ribs 80 are same as those of the container illustrated in FIGS. 1-6.

Although not shown in FIGS. 7-12, the upper body 61 of the container of FIGS. 7-12 may be provided with a plurality of projections as shown in FIG. 1.

Figure 11:
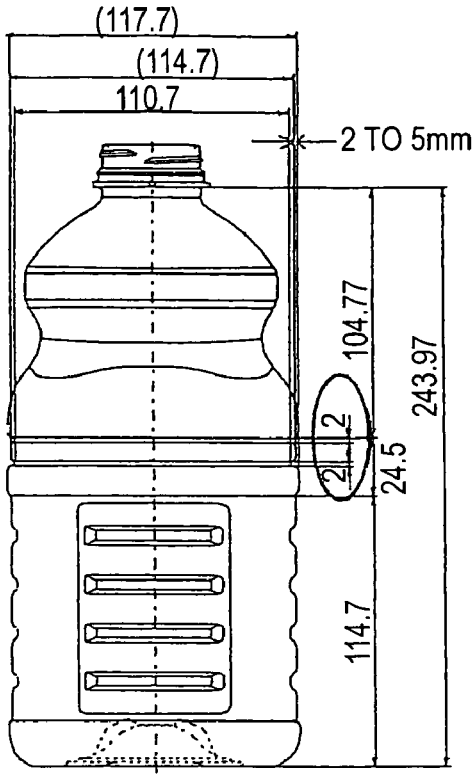
FIG. 11 is a schematic front view of the embodiment of the second aspect of the invention same as that illustrated in FIG. 7 except that the vacuum panels are not formed on the shorter sides, and that the dimensions of some parts are shown.
Figure 12:
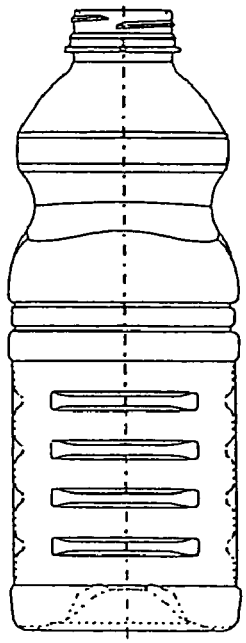
FIG. 12 is a schematic lateral view of the embodiment of the second aspect of the invention same as that illustrated in FIG. 8 except that the vacuum panels are not formed on the shorter sides.

FIGS. 11 and 12 show an example which is substantially same as the example illustrated in FIGS. 7-10, except that the vacuum panel 66 is not formed on the shorter sides of the lower body 62. While FIG. 11 shows dimensions of some parts of the container, the present invention is by no means limited thereto. In the example, the upper body 61 includes rib 65. In these drawings, the upper body 61 shows a height of 127.2 mm. Recessed grooves 74, 75 having a width of 2 mm are formed respectively at the upper end and the lower end in the rib 65.

In line with the invention as illustrated in FIGS. 7-12, the synthetic resin container was prepared or formed. Note that the formed container has dimensions (particularly, the vacuum panel 76) that are not same as those illustrated in FIGS. 7-10 and 11-12.

Circumferential length of the lower body 62: 365.7 mm

Height of the lower body 62: 127.2 mm

Height of the label section 69: 95 mm

Surface area of the lower body 62: (365.7×127.2=) 46517.0 $mm^2$

Surface area of the label section 69: (365.7×95=) 34741.5 $mm^2$

The container having the above listed dimensions showed a capacity of 64 ounces (about 1.8 liters). The internal pressure of the container is reduced when the temperature of the contents is reduced from about 70 to 100° C. to the room temperature in a state where the cap is closed. The capacity necessary to absorb the pressure reduction is at least 60 ml, preferably not less than 80 ml.

In order to absorb such capacity, vacuum panels 66, 66 and 76, 76 were formed respectively on the longer sides and the shorter sides of the lower body 62.

Each of the vacuum panels 66 on longer sides: 61 mm (width)×89 mm (height)

Each of vacuum panels 76 on shorter sides: 61 mm (width)×71 mm (height)

Area of the panel 66 on each longer sides: 61 mm (width)×89 mm (height)=5429 $mm^2$ Total area of the panels 66, 66 on longer sides: 5429 $mm^2$×2=10858 $mm^2$ Area of the panel 76 on each shorter sides: 61 mm (width)×71 mm (height)=4331 $mm^2$ Total area of the panels 76, 76 on shorter sides: 4331 $mm^2$×2=8662 $mm^2$ Total area of the panels 66, 66, 76, 76: 10858 $mm^2$+8662 $mm^2$=19520 $mm^2$ Thus, the container of this example can absorb 60 ml (preferably 80 ml) by means of the vacuum panels having the total area of 19520 $mm^2$.

After opening the cap, the reduced pressure in the inside of the container is dissolved. In this case, the vacuum panels restores the original profiles. In order to improve the restoration, each of the panels 66, 66 is provided with four transversal ribs 70, and each of the panels 76, 76 is provided with four transversal ribs 80.

Transversal ribs 70 on each panel 66 of longer sides: 56 mm (width)×8 mm (height)×4

Ratio of the horizontal length (width) of each transversal rib 70 to the horizontal length of corresponding panel 66: 56/61=91.8%

Ratio of a total axial length (height) of four transversal ribs 70 to the axial length of corresponding panel 66: (8×4)/89=36.0%

Ratio of a total area of four transversal ribs 70 to the area of corresponding panel 66: (56×8×4)/5429=33.3%

Transversal ribs 80 on each panel 76 of shorter sides: 59.8 mm (width)×8 mm (height)×4

Ratio of the horizontal length (width) of each transversal rib 80 to the horizontal length of corresponding panel 76: 59.8/61=98.0%

Ratio of a total axial length (height) of four transversal ribs 80 to the axial length of corresponding panel 76: (8×4)/71=45.1%

Ratio of a total area of four transversal ribs 80 to the area of corresponding panel 76: (59.8×8×4)/(61×71) =44.2%

The container was filled with liquid heated to about 90° C., and capped. Subsequently, the container was observed until the contained liquid is cooled to the room temperature. Although the vacuum panels 66, 76 were deformed inwardly, the appearance of the container was not significantly affected. It was confirmed that the vacuum panels 66, 76 restored their original profiles when the cap was removed.

The invention claimed is:

1. A large container made of synthetic resin comprising:

a neck; and a body, the body having a substantially rectangular cross section, and including an upper body and a lower body, the upper body having a center of gravity of the container when filled with liquid, the upper body having a waist section having a cross-section that is symmetric about two perpendicular axes and containing the center of gravity, the upper body having a plurality of projections that extend in an axial direction of the container, the waist section having a grip, the grip being structured not to absorb a negative pressure in the container, and the area of the grip is made so small as to only snugly receive a finger tip, at least one surface of the lower body including a vacuum panel, and the waist section having a diameter smaller than a largest diameter of the upper body.

2. The container according to claim 1, wherein the waist section has a height equal to about 20 to 40% of a height of the upper body.

3. The container according to claim 1, wherein the waist section has a depth of 4 to 15 mm relating to the largest diameter of the upper body.

4. The container according to claim 1, wherein the grip has a height not greater than about 33% of a height of the upper body.

5. The container according to claim 1, wherein the grip has a width equal to about 35 to 80% of a width of a longer side of the upper body.

6. The container according to claim 1, wherein the grip has a depth of about 5 mm or less from a wall of the waist section.

7. The container according to claim 1, wherein the vacuum panel has an area equal to 30.6 to 48.6% of a surface area of the lower body.

8. The container according to claim 1, wherein the lower body has a substantially flat label section; and the vacuum panel has an area equal to about 39.3 to 62.4% of an area of the label section.

9. The container according to claim 1, wherein the vacuum panel has at least one transversal rib.

10. The container according to claim 9, wherein the transversal rib has a width not smaller than 85.0% of a width of the vacuum panel.

11. The container according to claim 1, wherein the cross section of the waist section is at least partially arcuate.

12. A large container made of synthetic resin, comprising:

a neck; and a body, the body having a substantially rectangular cross section, and including an upper body and a lower body, the upper body containing a center of gravity of the container when filled with liquid, the upper body having a rib containing the center of gravity, the rib being structured not to absorb a negative pressure in the container and being structured to surround the container, the area of the rib is made so small as to only snugly receive a finger tip, and at least one surface of the lower body including a vacuum panel.

13. The container according to claim 12, wherein the rib operates as a grip.

14. The container according to claim 12, wherein the rib has a height equal to about 2 to 10% of a height of the upper body.

15. The container according to claim 12, wherein the rib has a depth of 2 to 5 mm relating to the largest diameter of the upper body.

16. The container according to claim 12, wherein the vacuum panel has an area equal to 23.3 to 42.0% of a surface area of the lower body.

17. The container according to claim 12, wherein the lower body has a substantially flat label section; and the vacuum panel has an area equal to about 31.3 to 56.2% of an area of the label section.

18. The container according to claim 12, wherein the vacuum panel has at least one transversal rib.

19. The container according to claim 18, wherein the transversal rib has a width not smaller than 85.0% of a width of the vacuum panel.

20. The container according to claim 12, wherein the cross section of the rib is symmetric about two perpendicular axes and is at least partially arcuate.

* * * * *